US007261592B2

(12) United States Patent
Korsunsky et al.

(10) Patent No.: US 7,261,592 B2
(45) Date of Patent: Aug. 28, 2007

(54) ELECTRICAL CONNECTOR

(75) Inventors: Iosif R. Korsunsky, Harrisburg, PA (US); Kevin E. Walker, Hershey, PA (US); James Hyland, Harrisburg, PA (US); Michael Yeomans, Camp Hill, PA (US); Yakov Belopolsky, Harrisburg, PA (US); Leonard Espenshade, Harrisburg, PA (US)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 0 days.

(21) Appl. No.: 11/019,689

(22) Filed: Dec. 21, 2004

(65) Prior Publication Data

US 2006/0134984 A1 Jun. 22, 2006

(51) Int. Cl.
*H01R 13/73* (2006.01)
*H01R 13/648* (2006.01)

(52) U.S. Cl. ..... 439/541.5; 439/95; 439/607

(58) Field of Classification Search ..... 439/541.5, 439/79, 620, 76.1, 95–96, 676, 607
See application file for complete search history.

(56) References Cited

U.S. PATENT DOCUMENTS

| | | | | |
|---|---|---|---|---|
| 4,909,743 | A * | 3/1990 | Johnson et al. | 439/79 |
| 6,132,260 | A * | 10/2000 | Wu | 439/676 |
| 6,159,040 | A * | 12/2000 | Chang et al. | 439/541.5 |
| 6,511,348 | B1 * | 1/2003 | Wojtacki et al. | 439/541.5 |
| 6,641,440 | B1 * | 11/2003 | Hyland et al. | 439/620 |
| 6,709,295 | B2 * | 3/2004 | Givens et al. | 439/620 |
| 6,840,817 | B2 * | 1/2005 | Chen | 439/676 |
| 6,945,820 | B1 * | 9/2005 | Blichasz et al. | 439/620 |

* cited by examiner

*Primary Examiner*—Felix O. Figueroa
(74) *Attorney, Agent, or Firm*—Wei Te Chung

(57) ABSTRACT

A stacked RJ21 receptacle (100) for mating with a mating connector includes a first RJ21 receptacle (2) and a second receptacle (3). An outer shield (1) shields the first and second receptacle. The first and second RJ21 receptacle each has a projecting portion projecting beyond the outer shield. The stacked RJ21 receptacle (100) further includes at least a printed circuit board (5) and a noise suppressing element (4) respectively electrically connecting with the first and second receptacles.

3 Claims, 9 Drawing Sheets

ELECTRICAL CONNECTOR

BACKGROUND OF THE INVENTION

1. Field of the Invention

The present invention generally relates to an electrical connector and particularly, to a connector which combines multiple modular jacks.

2. Description of the Prior Art

It is quite common to use modular jacks for the data transmission in high speed applications such as IEEE 802.3 10 Base-T or 100 Base-T local area networks. A common problem to these high speed modular jacks is their tendency to combine many ports into one cable and plug. However, a conventional modular jack usually includes a plurality of dual juxtaposed modular jacks mounted in an integral main housing. In fact, the conventional modular jack still complicates the manufacture process and increases the production cost at the same time. In order to reduce the cost and space requirement, the present invention is capable of combining many ports into one plug via a special receptacle. The special receptacle has a more larger plug interface than the RJ45 but serves the same purpose as the RJ45.

Hence, an improved modular jack is desired to overcome the above problems.

BRIEF SUMMARY OF THE INVENTION

It is an object of the present invention to provide a modular jack which can combine many ports into one plug.

A stacked RJ21 receptacle for mating with a complementary connector includes a first RJ21 receptacle and a second receptacle. An outer shield shields the first and second receptacle. The first and second RJ21 receptacle each has a projecting portion projecting beyond the outer shield. The stacked RJ21 receptacle further includes a magnetic box, a first printed circuit board, a second printed circuit board and a third printed circuit board. The first printed circuit board is disposed above the magnetic box having a plurality of transient voltage suppressors, the second printed circuit board is disposed on a bottom surface of the first printed circuit board and the third printed circuit board is disposed on a bottom surface of the magnetic box.

Other objects, advantages and novel features of the invention will become more apparent from the following detailed description of the present embodiment when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE INVENTION

Figure 1:
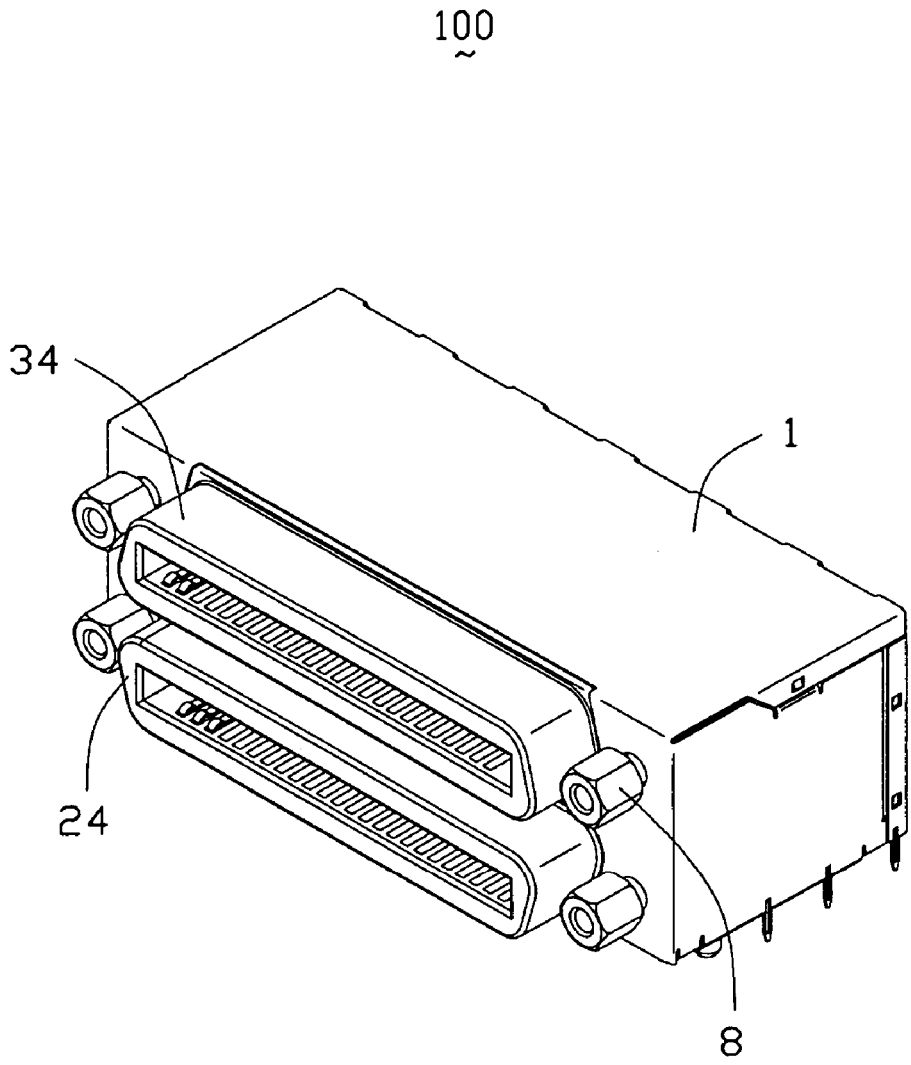
FIG. 1 is a perspective view of a modular jack according to a first embodiment of the present invention.

Reference will now be made in detail to the preferred embodiment of the present invention.

Referring to FIGS. 1-4, an electrical connector 100 according to a first embodiment includes a metal outer shield 1 for preventing electromagnetic interference (EMI), a first RJ21 receptacle 2, a second RJ21 receptacle 3 stacked with the first RJ21 receptacle 2, a magnetic box 4, a first printed circuit board (PCB) 5, a second PCB 6 and a third PCB 7 respectively positioned on top and bottom surfaces of the magnetic box 4 and two pairs of jack screws 8.

Figure 3:
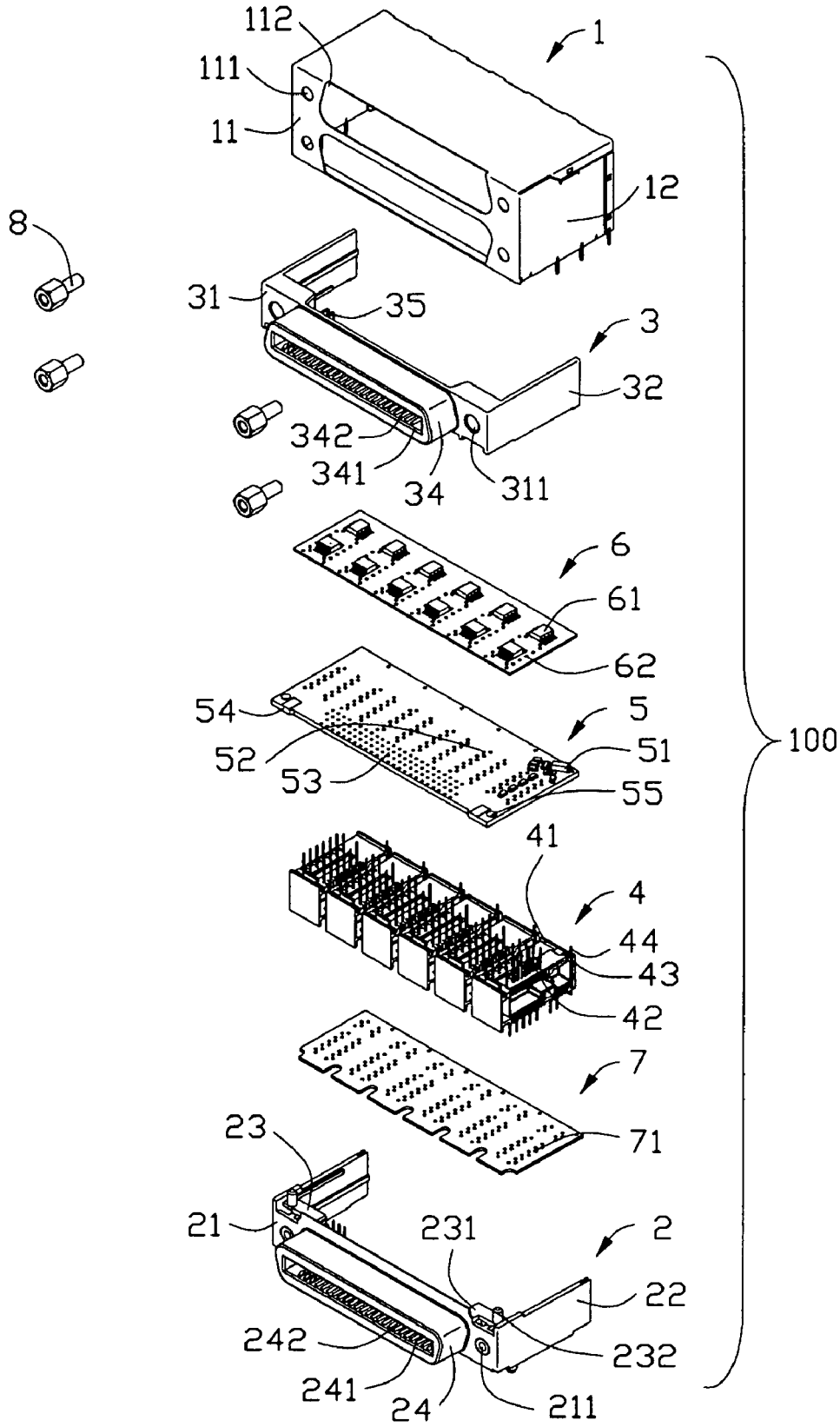
FIG. 3 is an exploded view of the modular jack.
Figure 4:
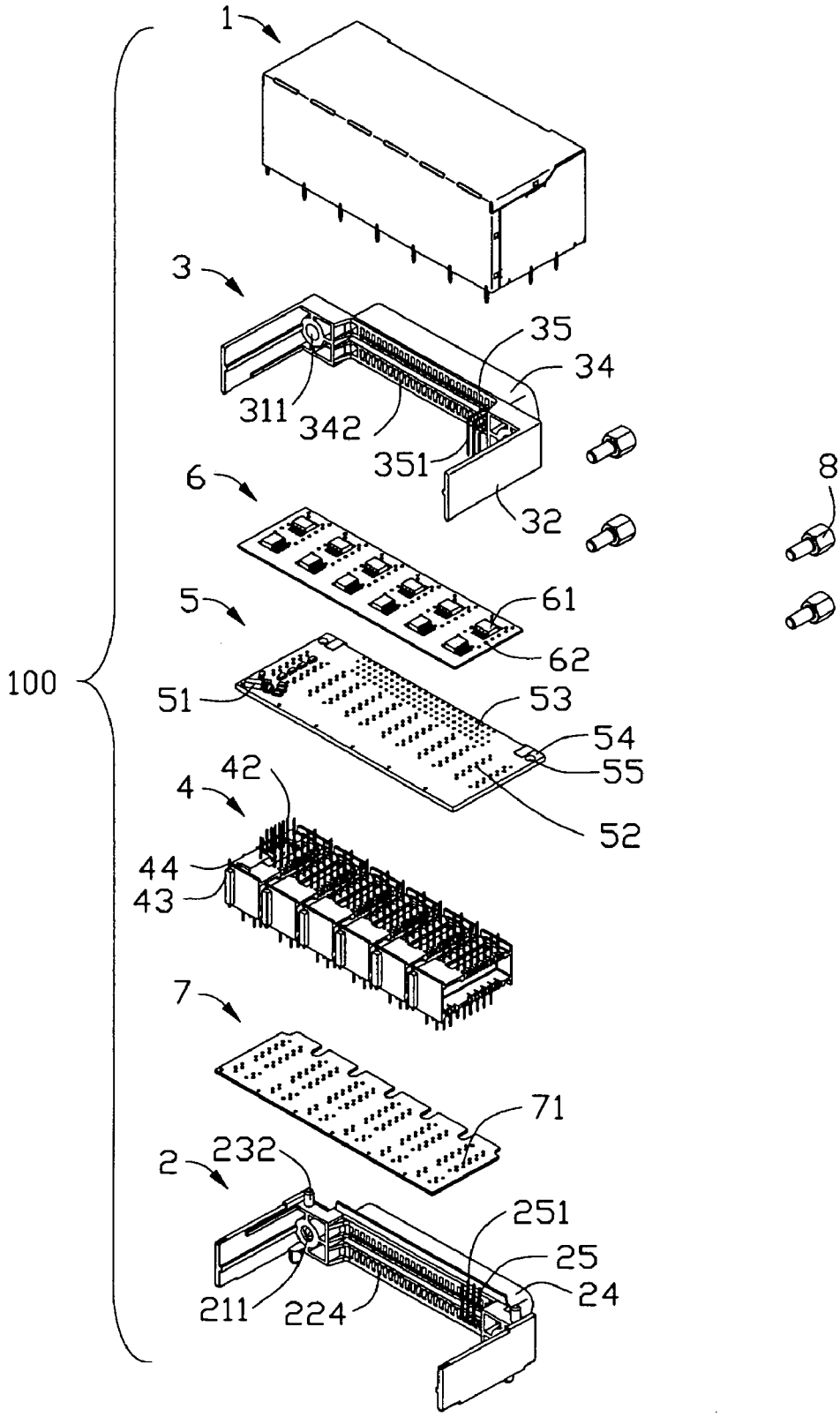
FIG. 4 is a similar view to FIG. 3 but taken from another perspective.
Figure 5:
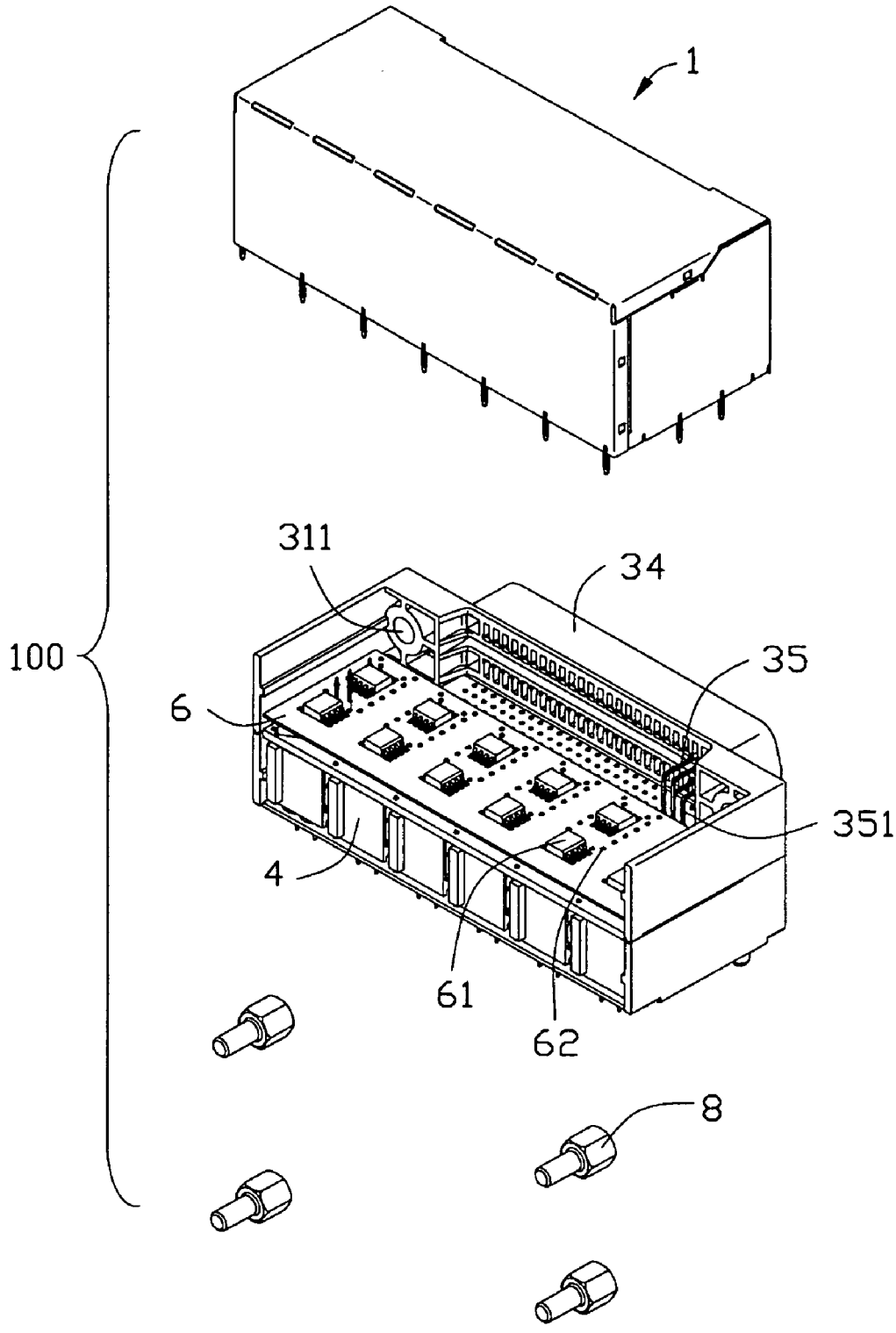
FIG. 5 is a partially exploded view of the modular jack with the outer shield removed.

Referring to FIGS. 3-4, the first RJ21 receptacle 2 includes a front mating face 21, a pair of sidewalls 22 extending from the front mating face 21 and a top surface 23. The front mating face 21 defines a pair of first through holes 211. A pair of second notches 231 is defined in a top surface 23 forwardly exposed to the air. A pair of posts 232 upwardly project from a top surface of the first RJ21 receptacle 2 and adjacent to corresponding notches 231. A longitudinal projecting portion 24 forwardly extends from the front mating face 21 and defines a first opening 241 through the front mating face 21. The opening 241 further defines a plurality of receiving channels 242 through the front mating face 21. A plurality of first contacts 25 with upwardly bending tails 251 are received in corresponding receiving channels 242.

Figure 2:
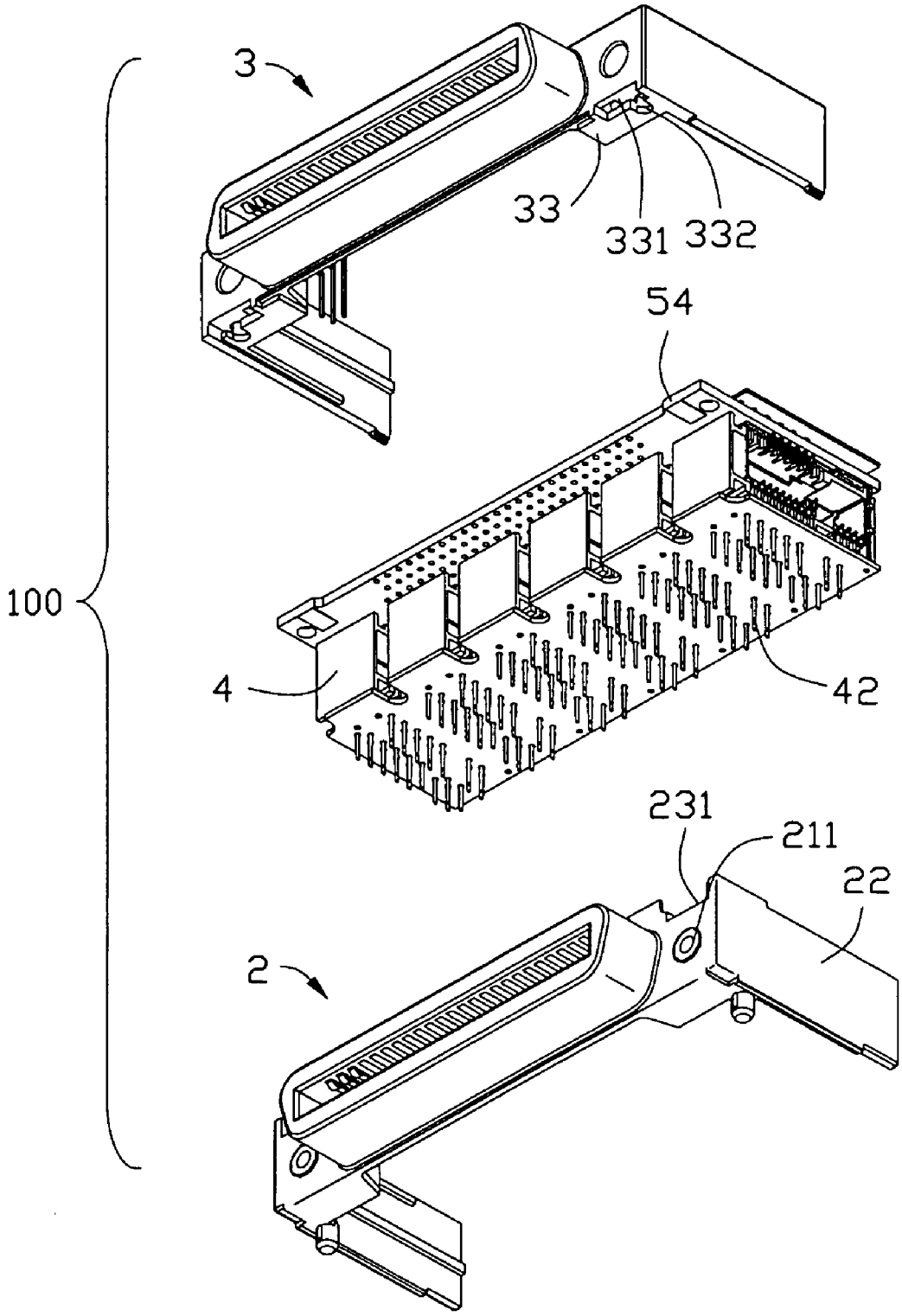
FIG. 2 is a partially exploded view of the modular jack.
Figure 6:
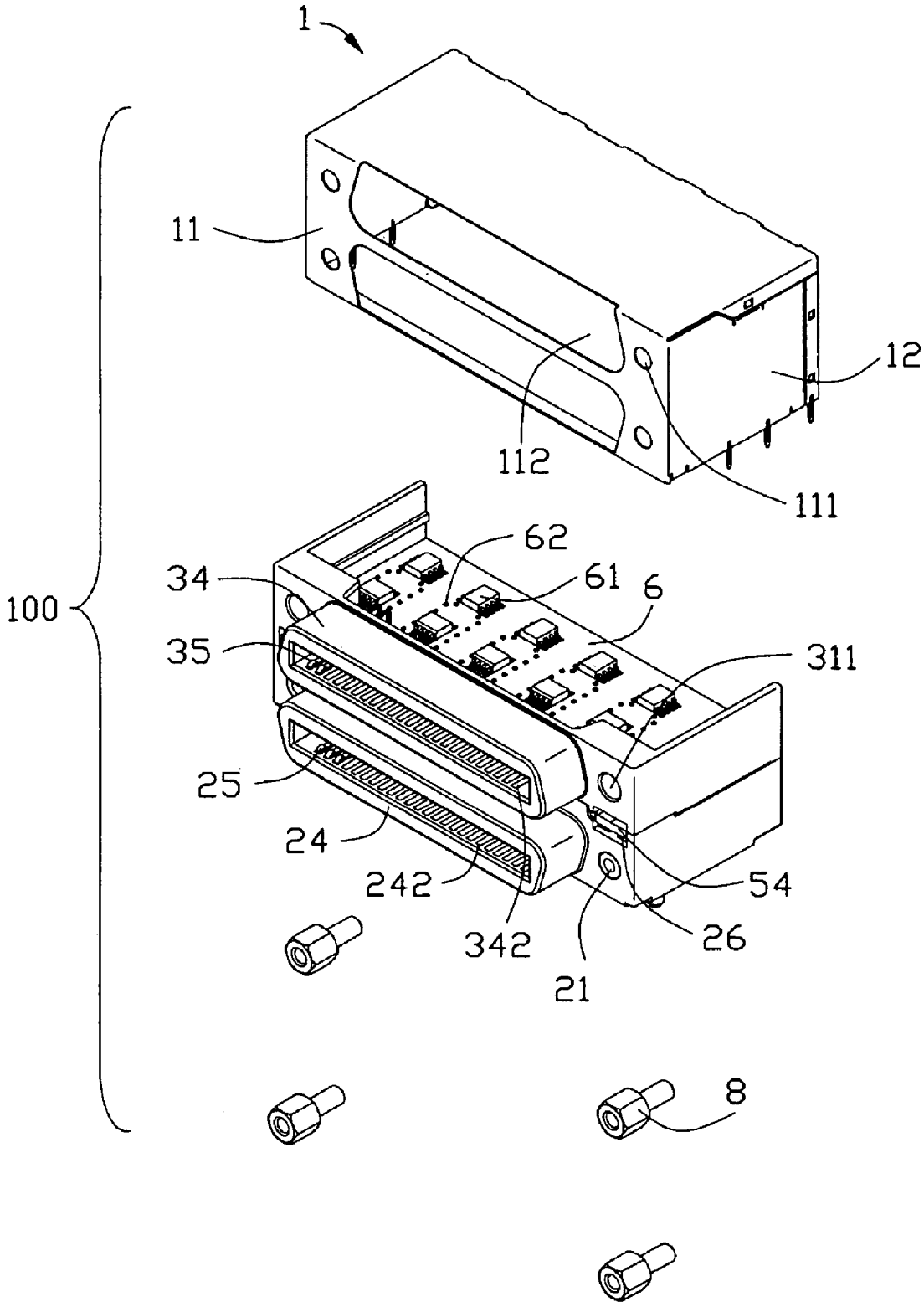
FIG. 6 is a similar view to FIG. 5 but taken from another perspective.
Figure 7:
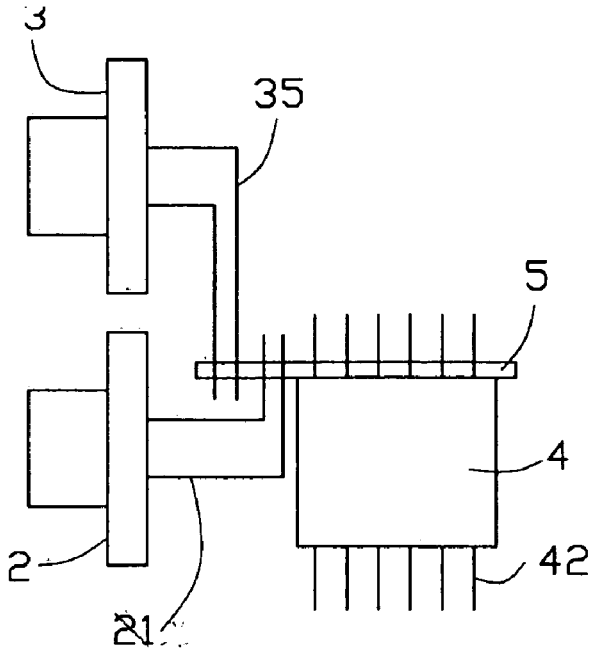
FIG. 7 is a schematic of the modular jack according to the present invention.

Referring to FIGS. 2-3, the second RJ21 receptacle 3 includes a front mating face 31, a pair of sidewalls 32 rearward extending from opposite sides of the front mating face 31 and a bottom surface 33. The front mating face 31 defines a pair of second through holes 311 adjacent to the sidewalls 32. The bottom surface 33 defines a pair of second notches 331 forwardly exposed to the air and respectively adjacent to a corresponding sidewall 32. The second notches 331 appropriately cooperate with the first notches 231 to form a pair of cutouts 26 (shown in FIG. 6). A pair of apertures 332 is defined in the bottom surface 33 and communicates with a corresponding notch 331 for receiving the posts 232 of the first receptacle 2. A longitudinal projecting portion 34 forwardly extends from the front mating face 31 and defines a second opening 341 through the front mating face 31. The longitudinal projecting portion 34 further defines a plurality of receiving channels 342 communicating with the opening 341. A number of second contacts 35 (shown in FIG. 4) with right angle tails 351 are received in corresponding receiving channels 342.

Referring to FIG. 3, the noise suppressing element, in this embodiment, is an integrated magnetic box. The integrated magnetic box 4 includes a number of plastic boxes 41 and a plurality of input and output pins 42 fixed by top and bottom portions of each plastic box 41. Each plastic box further defines a groove 43 positioned in a side thereof and a ground pin 44 is inserted in the groove 43.

The first PCB 5 positioned on the magnetic box 4 is wider than the magnetic box 4 and carries a plurality of signal conditioning components 51, such as resistors and capacitors for filtering electromagnetic interference. The first PCB 5 defines a plurality of through holes 52 for exposing the pins 42 of the magnetic box 4. The first PCB 5 further defines a plurality of pinholes 53 to make the first and second contacts 25, 35 of the first and second RJ21 receptacle 2, 3 penetrate through corresponding pinholes 53 and electrically connect with the pins 42 via electrical traces (not shown) thereof. In addition, the first PCB 5 forms a pair of conductive surfaces 54 on opposite sides thereof and appropriately exposed in corresponding cutouts 26 for grounding through contacting with the metal outer shield 1. Furthermore, the first PCB 5 defines a pair of holes 55 to make the posts 232 of the first receptacle 2 penetrate and be inserted into the notches 332 of the second receptacle 3, thereby the first PCB 5 being securely retained between the first and the second receptacles 2, 3.

The second PCB 6 is disposed above the first PCB 5 and comprises a plurality of transient voltage suppressors 61 (TVS) and a plurality of electrical nods 62. The input and output pins 42 of the magnetic box 4 penetrate through the through holes 52 of the first PCB 5 to electrically connect with the electrical nods 62 of the second PCB 6.

The third PCB 7 positioned in a bottom surface of the magnetic box 4 is similar to the first PCB 5 and includes a plurality of through holes 71. In addition, the pins 42 of the magnetic box 4 penetrate through the through holes 71 of the third printed circuit 7 to electrically connect with a mother PCB of an outer equipment (not shown).

The metal outer shield 1 shields the first and second RJ21 receptacles 2, 3 and includes a front mating face 11, a pair of sidewalls 12. The front mating face 11 defines two pairs of third through holes 111 respectively adjacent to the sidewalls 12 for appropriately exposing the first and second through holes 211, 311 of the first and second RJ21 receptacles 2, 3. The jack screws 8 are inserted into the first and second through holes 211, 311 via the third through holes 111. A pair of third openings 112 respectively is defined in a top and bottom portion of the front mating face 11 for appropriately exposing the first and second longitudinal projecting portions 24, 34 of the first and second RJ21 receptacles 2, 3.

Referring to FIGS. 1-7, in assembly, firstly, the first PCB 5 is disposed above the first receptacle 2, then the second receptacle 3 is stacked above the first receptacle 2. The posts 232 of the first receptacle 2 penetrate through the holes 55 of the first PCB 5 to be inserted into the notches 332 of the second receptacle 3, thereby the first PCB 5 being securely retained between the first and the second receptacles 2, 3. In addition, the first and the second contacts 25, 35 are inserted into the corresponding pinholes 53 of the first PCB 5. Secondly, the third PCB 7 is assembled to the bottom portion of the magnetic box 4, then the magnetic box 4 is disposed under the first PCB 5. At the same time, the pins 42 of the magnetic box 4 penetrate through the through holes 52 of the first PCB 5 and electrically connect with the first and the second contacts 25, 35 of the first and the second receptacle 2, 3. Thirdly, the second PCB 6 is disposed above the first PCB 5. The pins 42 of the magnetic box 4 electrically connect with the second PCB 6. Finally, the metal outer shield 1 encloses the first and second RJ21 receptacles 2, 3 with the jack screws 8 being inserted into the first and second through holes 211, 311 via the third through holes 111.

In use, when a pair of plugs (not shown) mate with the first and second RJ21 receptacles 2, 3, the signals is transmitted through the first and second contacts 25, 35 and the pins of the magnetic box 4 to the mother PCB of the outer equipment. At the same time, since the first and second contacts 25, 35 electrically connect with the first and second printed circuit bard 5, 6 and the magnetic box 4, the electromagnetic interference caused in the transmission will be affected via the signal conditioning components of the first PCB 5. In addition, the conductive surfaces 54 of the first PCB 5 contacting with the metal outer shield 1 via the cutout 26 for grounding, thereby further eliminating the electromagnetic interference.

It is noted that there are other connection methods for connecting the first and second RJ21 receptacles. FIGS. 8-11 are schematic diagrams showing other embodiments about the connection method. The elements of other embodiments are similar to the elements of the first embodiment of the present invention.

Figure 8:
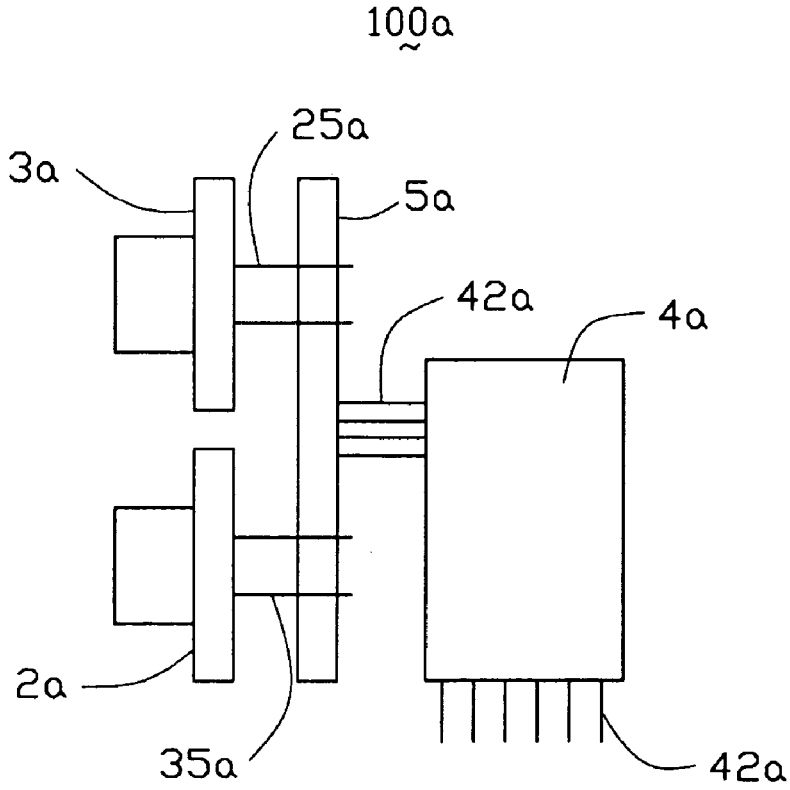
FIG. 8 is a schematic diagram of a modular jack according to a second embodiment of the present invention.

Referring to FIG. 8, in this embodiment, a electrical connector 100*a* according to a second embodiment of the present invention comprises a vertical PCB 5*a* and a noise suppressing element 4*a*. The noise suppressing element 4*a* has a plurality of pins 42*a* with right angle pressed in the noise suppressing element 4*a* to directly electrically connect with the vertical PCB 5*a*. A first and second RJ21 receptacles 2*a*, 3*a* respectively have a plurality of contacts 25*a*, 35*a* electrically connecting with the vertical PCB 5*a*.

Figure 9:
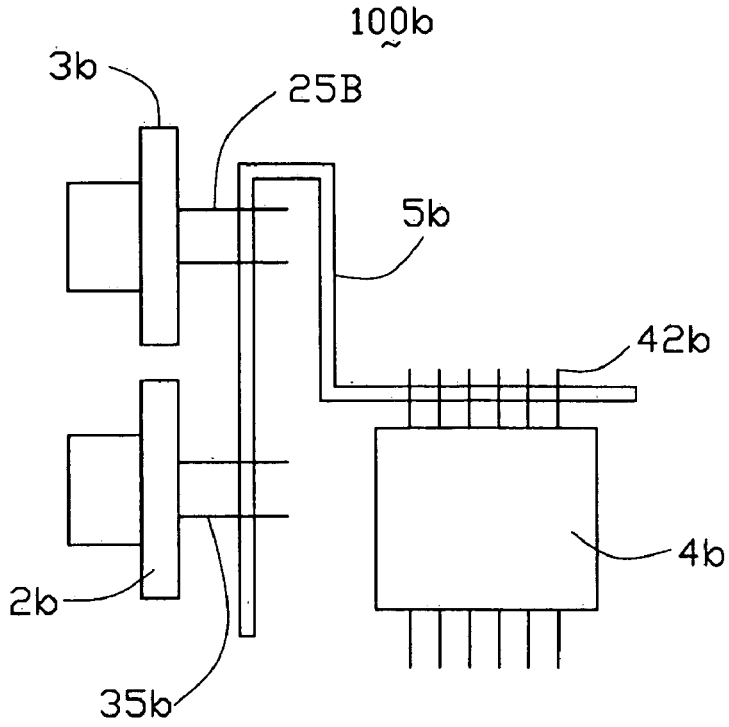
FIG. 9 is a schematic diagram of a modular jack according to a third embodiment of the present invention.

Referring to FIG. 9, in this embodiment, a electrical connector 100*b* according to a third embodiment of the present invention comprises a flexible PCB 5*b*. A first and second RJ21 receptacles 2*b*, 3*b* respectively have a plurality of straight contacts 25*b*, 35*b* extending through and electrically connecting with the flexible PCB 5*b*. A suppressing element 4*b* comprises a plurality of pins 42*b* electrically connecting with the flexible PCB 5*b*.

Figure 10:
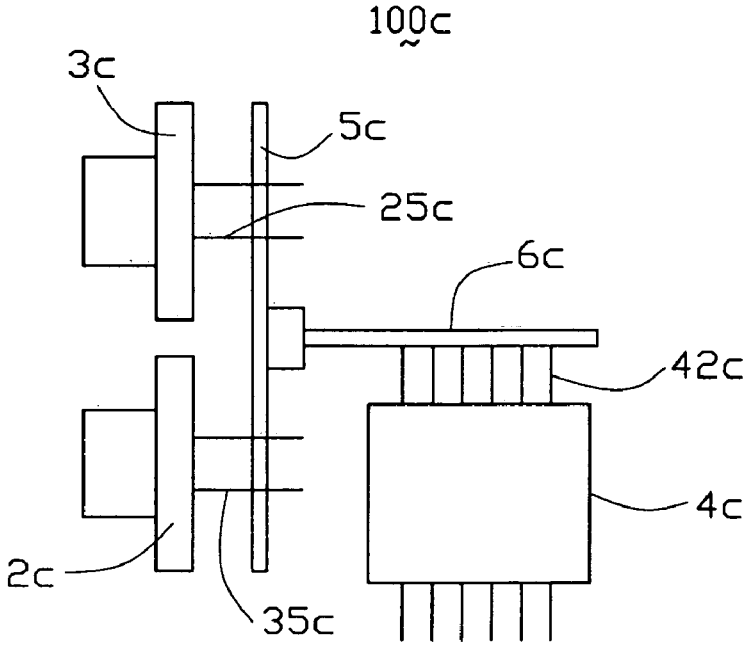
FIG. 10 is a schematic diagram of a modular jack according to a fourth embodiment of the present invention.

Referring to FIG. 10, in this embodiment, a electrical connector 100*c* according to a fourth embodiment of the present invention comprises a vertical PCB 5*c* and a horizontal PCB 6*c* assembled to the vertical PCB 5*c* in any know manners, such as by card edge or right angle pin header etc. A first and second RJ21 receptacles 2*c*, 3*c* respectively have a plurality of contacts 25*c*, 35*c* extending through and electrically connecting with the vertical PCB 5*c*. A suppressing element 4*c* includes a plurality of pins 42*c* electrically connecting with the horizontal PCB 6*c*.

Figure 11:
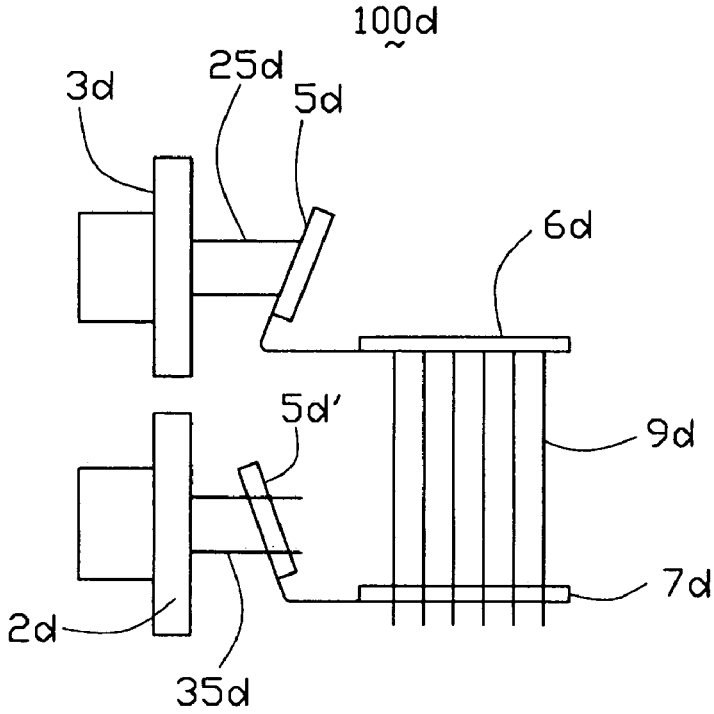
FIG. 11 is a schematic diagram of a modular jack according to a fifth embodiment of the present invention.

Referring to FIG. 11, in this embodiment, a electrical connector 100*d* according to a fifth embodiment of the present invention comprises a first and second RJ21 receptacles 2*d*, 3*d* respectively electrically connecting two flexible PCBs 5*d*, 5*d*', which in turn are each attached to horizontal PCBs 6*d*, 7*d*. A first and second contacts 25*d*, 35*d* of the first and second RJ21 receptacles respectively electrically connect with the flexible PCBs 5*d*, 5*d*'. In this embodiment, the electrical connector 100*d* doesn't use a noise suppressing element. The noise suppressing element comprises two horizontal PCBs 6*d*, 7*d* organizing and retaining a plurality of footers 9*d* therebetween.

Figure 12:
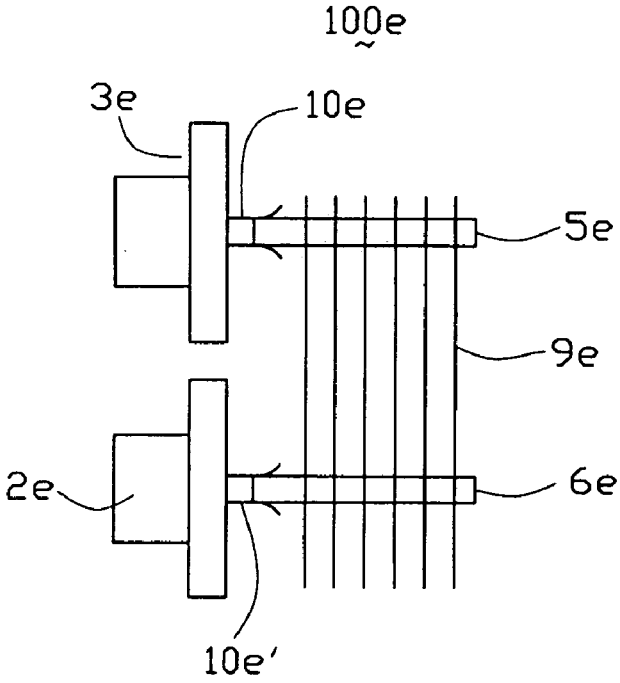
FIG. 12 is a schematic diagram of a modular jack according to a sixth embodiment of the present invention.

Referring to FIG. 12, in this embodiment, a electrical connector 100*e* comprises a first and second RJ21 receptacles 2*e*, 3*e* respectively connected to horizontal PCBs 5*e*, 6*e* via card edge 10*e*, 10*e*' that are integrated to the RJ21 receptacles 2*e*, 3*e*. The horizontal PCBs 5*e*, 6*e* comprises a plurality of footer pins electrically connecting each other.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector adapted on a mother printed circuit board, comprising:

a first receptacle having a projecting portion defining a first opening for mating with a first complementary connector, the first opening defining a plurality of first channels and a plurality of first contacts received in the first channels;

a first printed circuit board disposed above first receptacle and defining a plurality of through holes and pinholes, the pinholes receiving the first contacts of the first receptacle;

a second receptacle stacked with the first receptacle, the second receptacle having a projecting portion defining a second opening for mating with a second complementary connector, the second opening defining a plurality of second channels and a plurality of second contacts received in the second channels of the second receptacle, ends of the second contacts being received in the pinholes of the first printed circuit board;

a magnetic box assembled to the first printed circuit board and having a plurality of pins penetrating the through holes of the first printed circuit board; and a bottom printed circuit board disposed below the magnetic box and defining a plurality of through holes to make the pins of the magnetic box penetrate and electrically connect with the mother printed circuit board;

a second printed circuit board containing a plurality of transient voltage suppressors;

an outer metal shield enclosing the first and the second receptacles, the magnetic box, the first and second circuit board; wherein the pins of the magnetic box penetrate the through holes of the first horizontal printed circuit board to electrically connect with the second printed circuit board for further suppressing the transient voltage; and wherein the first and the second receptacles respectively have a mating face defining a notch exposed to air, and wherein the first printed circuit board includes a conductive surface received in the notch to contact with the outer shield for grounding.

2. The electrical connector according to claim 1, wherein the second receptacle defines a pair of apertures communicating with the notches, and wherein the first receptacle forms a pair of posts to be received in the apertures of the first receptacle.

3. The electrical connector according to claim 2, wherein the first printed circuit board defines a pair of holes for receiving the posts of the first receptacle, thereby the first printed circuit board being retained between the first and the second receptacles.

* * * * *